US009144338B1

(12) United States Patent
Skinner

(10) Patent No.: US 9,144,338 B1
(45) Date of Patent: Sep. 29, 2015

(54) BRA DRESSING ASSIST DEVICE

(71) Applicant: Tracy Skinner, Jonesborough, TN (US)

(72) Inventor: Tracy Skinner, Jonesborough, TN (US)

( * ) Notice: Subject to any disclaimer, the term of this patent is extended or adjusted under 35 U.S.C. 154(b) by 0 days.

(21) Appl. No.: 14/120,833

(22) Filed: Jul. 1, 2014

Related U.S. Application Data

(60) Provisional application No. 61/957,438, filed on Jul. 2, 2013.

(51) Int. Cl.
*A47G 25/90* (2006.01)
*A41C 3/00* (2006.01)
*A44B 11/20* (2006.01)

(52) U.S. Cl.
CPC ..... *A47G 25/90* (2013.01); *A41C 3/005* (2013.01); *A44B 11/20* (2013.01)

(58) Field of Classification Search
CPC ..... A47G 25/90; A47G 25/905; A41C 3/00; A41C 3/005; A41C 3/02; A41C 3/0028; A44B 11/10; A44B 11/20; A44B 11/22; A44B 11/2553
USPC ..... 223/111
See application file for complete search history.

(56) References Cited

U.S. PATENT DOCUMENTS

| | | | | | |
|---|---|---|---|---|---|
| 1,445,075 | A * | 2/1923 | Erpenbeck | 24/186 |
| 2,521,373 | A * | 9/1950 | Hutchison | 450/77 |
| 2,592,148 | A * | 4/1952 | Isaacs | 2/237 |
| 3,209,423 | A * | 10/1965 | Cattin | 24/181 |
| 3,229,351 | A * | 1/1966 | Peterson et al. | 492/48 |
| 4,072,255 | A * | 2/1978 | Bogorad | 223/111 |
| 4,300,568 | A * | 11/1981 | Blanckmeister | 450/85 |
| 5,593,071 | A * | 1/1997 | Lusk | 223/112 |
| 6,253,424 | B1 * | 7/2001 | Rainville-Lonn | 24/306 |
| 9,004,327 | B2 * | 4/2015 | Kissel, Jr. | 223/118 |
| 2014/0252050 | A1 * | 9/2014 | Buckingham | 223/111 |

* cited by examiner

*Primary Examiner* — Ismael Izaguirre

(57) ABSTRACT

A strap shaped coiled mandrel of resilient material, which mandrel is expanded against the connected elastic base (connected bra straps) of a bra whereby the mandrel with bra held thereon can be slid down over a females shoulder to position the bra on the breasts, and wherein releasable stop means are provided on the mandrel for adjusting and temporarily maintaining the circumferential dimension of the coiled mandrel and bra base thereon.

7 Claims, 6 Drawing Sheets

BRA DRESSING ASSIST DEVICE

FIELD

This invention is an assist device for use by women in donning their bra where the wearer has lost an arm or whose arm or hand is non-functional as the result, e.g., of stroke or injury.

PRIOR ART

Applicant knows of no device which resembles the present one for assisting in the donning procedure described herein in detail. U.S. Pat. Nos. 6,123,601 and 4,879,766 and publication US 201310065483A1, the disclosures of which are hereby incorporated herein by reference in their entireties, are examples of prior devices which are designed for assisting women who have some disability such as diminished hand dexterity, to fasten their bra at the back, but no devices are known which are constructed and which function in totally in such wearer friendly manner as applicants devices.

SUMMARY OF THE INVENTION

The present invention in one preferred embodiment is summarized as a bra donning assist device comprising a substantially linear strap like mandrel of semi-rigid, flexible resilient plastic material of a length sufficient when coiled to have at least about 1½ whorls to its adjusted circumference with the bra elastically held onto the coil periphery to be easily slid down over the wearers shoulders and encircle the upper torso breast area of a female, wherein cooperating releasable locking elements are provided on one end portion of an outer whorl of said coil and on an intermediate portion of an adjacent inner whorl of said coil, whereby the coiled and locked mandrel can be nested within the flexible fastened straps (bra base) of a bra and then the lock released to allow the coiled mandrel to radially snap expand against the fastened bra straps (bra base) to tightly hold the bra onto the mandrel whereby the mandrel with bra attached can be further circumferentially expanded if necessary and placed with one hand over the head and breast area of the wearer and brought down to a desired position, wherein the mandrel can then be slid easily down and away from the bra and from the wearers torso.

BRIEF DESCRIPTION OF THE DRAWINGS

The present device is shown in the accompanying drawings wherein the various figures are not drawn to scale or consistent proportions and some of the structures are shown with enlarged thickness for clarity, and wherein.

DETAILED DESCRIPTION

Figure 1:
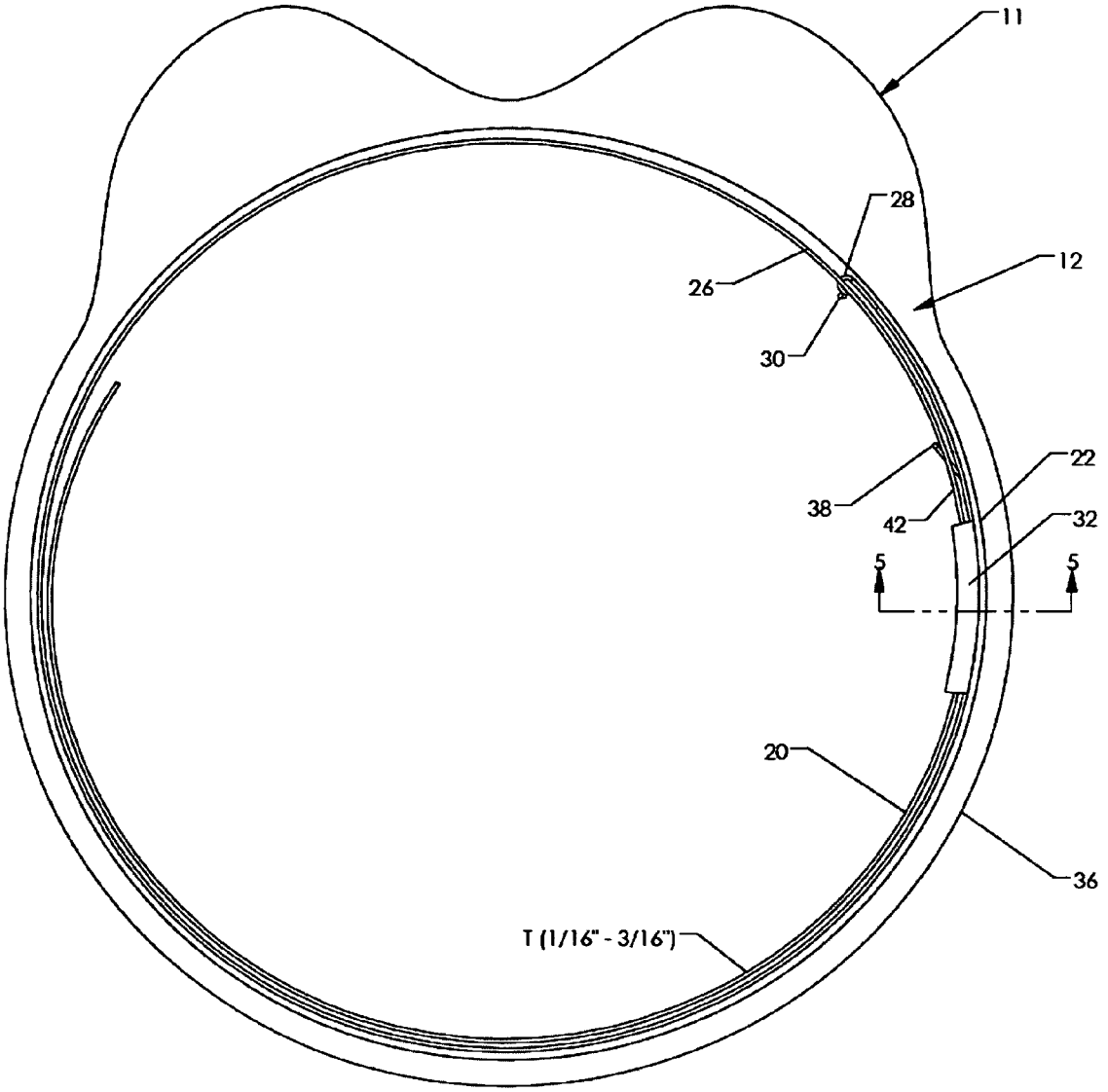
FIG. 1 is a top edge view showing the present coiled mandrel nested within the layed out—unstretched—bra in preparation for release of the circumference locking means (anchor lock), which release will allow the coiled mandrel to uncoil and expand against the bra base and hold the bra in that position or in a manually circumferentially expanded adjusted position as the mandrel with the bra frictionally held thereon is placed down over the wearers head and shoulders.
Figure 2:
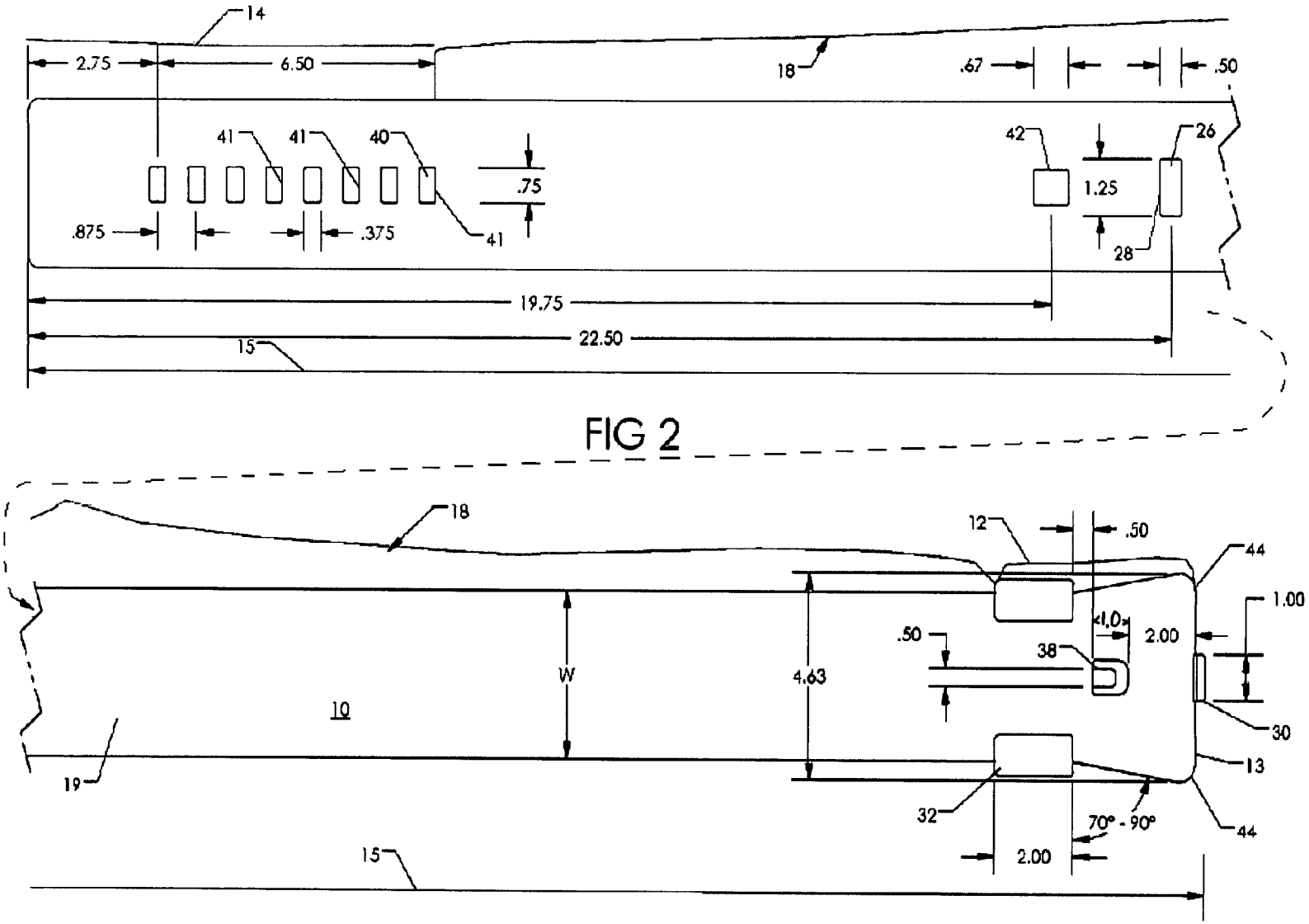
FIG. 2 is a plan view of the inner side (when coiled) of the present mandrel in its relaxed state and showing typical dimensions of its components.

Referring to the drawings and the claims herein, FIG. 1 shows the mandrel as a coiled plastic band 10 of, for example, ABS (acrylonitrile-butadiene-styrene moieties) having in preferred dimensions a side width "W" of about 2-7 inches, a thickness "T" of about 1/32" to about ⅛" depending on the resiliency properties of the plastic, and a linear length 15 of about 3-7 ft or greater. When coiled up to at least about 1½" whorls to an initial functional state for placing within a layed-out substantially circular arranged bra 11 the coiled band (mandrel) typically would be about 7-12 inches in diameter for most wearers and when expanded to the circumference ready for placing over the wearers shoulders the diameter would typically be between about 11-16 inches. The band is of resilient sheet material such as the ABS, a polyolefin, polybutyrate, polyamide, polyurethane, polyester or the like plastic sheeting and preferably having a resiliency sufficient to allow the coil to restore itself to its initial relaxed linear state as shown in FIG. 2 or to its alternative initial relaxed coiled state also as shown in FIG. 1.

The mandrel has a proximal end section 12 having a terminal end 13, a distal end section 14 and an intermediate (neutral) section 18, and in its coiled state has an inner whorl 20 and an outer whorl 22. An anchor slot 26 is formed through said mandrel from outer side 17 to inner side 19 wherein an edge portion of the slot provides, with reference to FIG. 1, an anchor stop shoulder 28 on inner whorl 20. A resilient locking anchor tab 30 on said proximal end section 12 of outer whorl 22 of said mandrel is adapted to extend radially inwardly through said anchor slot 26 when said mandrel is coiled up to releasably lock said outer whorl 22 to said inner whorl 20 which prevents inopportune release of the mandrel from its coiled initial anchor state. A guide means 32 is provided on proximal end section 12 of said mandrel, wherein said distal end section 14 and intermediate (neutral) section 18 of said mandrel can easily slide longitudinally within said guide means to form the coiled configuration of said mandrel. The locking anchor tab 30 is formed integrally with said mandrel body and is adapted to be resiliently flexed in the direction 34 (FIG. 3) to release itself from said anchor stop shoulder 28 and allow the mandrel body to uncoil and circumferentially expand itself against the elastic base (connected bra straps) 36 of bra 11. The guide means 32 as shown, e.g., in FIG. 1 is curved longitudinally to further assist in guiding the mandrel body into a coiled state wherein the whorls lie closely adjacent to each other which further insures that the circumference adjustment locking tab 38 (FIG. 4) will lock into one of the circumference adjusting slots 40 and prevent collapsing of the coil by the radially inward forces generated by the stretched elastic bra base 36. It is noted that where the normal expansion forces of the coiled band 10 of FIG. 2 are insufficient to expand the bra base 36 to go over the wearer shoulders, the wearer must manually expand the coil whereby tab 38 will ratchet into the desired slot 40.

The two embodiments of the present invention as shown in the drawings are (1) the mandrel is substantially linear (FIG. 2) in its relaxed uncoiled, initial state, and (2) the mandrel is pre-coiled in its relaxed state to provide inner whorl 20 and outer whorl 22 and wherein the distal end section 14 of the mandrel is already slidably mounted through the guide means 32 to the extent which gives a circumference to the mandrel slightly less than the circumference of the layed-out bra base 36 as shown in FIG. 1.

Circumference adjusting lock tab 38 has a longitudinal axis 39 and extends radially inwardly sufficiently to insure that adjustment lock shoulder means 41 engages stop surface 43 of tab 38 when and if inner whorl 20 begins to rotate in a coil contracting direction 46. It is noted that when inner whorl 20 is slid through guide means 32 in the direction of arrow 48 to expand the mandrel, adjustment slot shoulders 41 will slidingly engage surface 52 of tab 38 and flex it out of the way in the direction of arrow 54 (FIG. 4) in a ratcheting manner.

Figure 3:
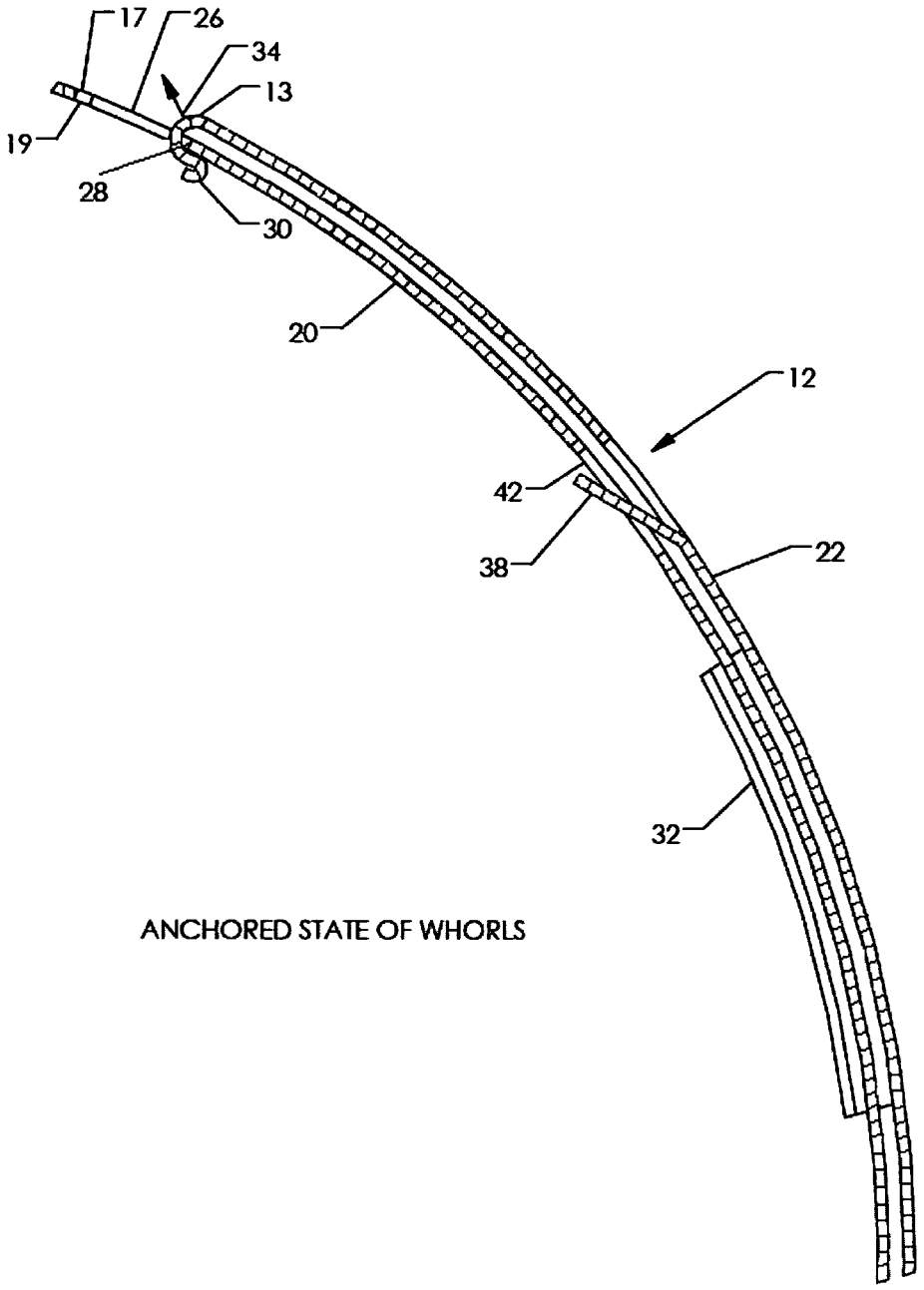
FIG. 3 is an enlarged cross-sectional (for clarity) view of the intermediate section of the mandrel of FIG. 1 showing the initial anchor positions of the coil whorls and locking means.
Figure 4:
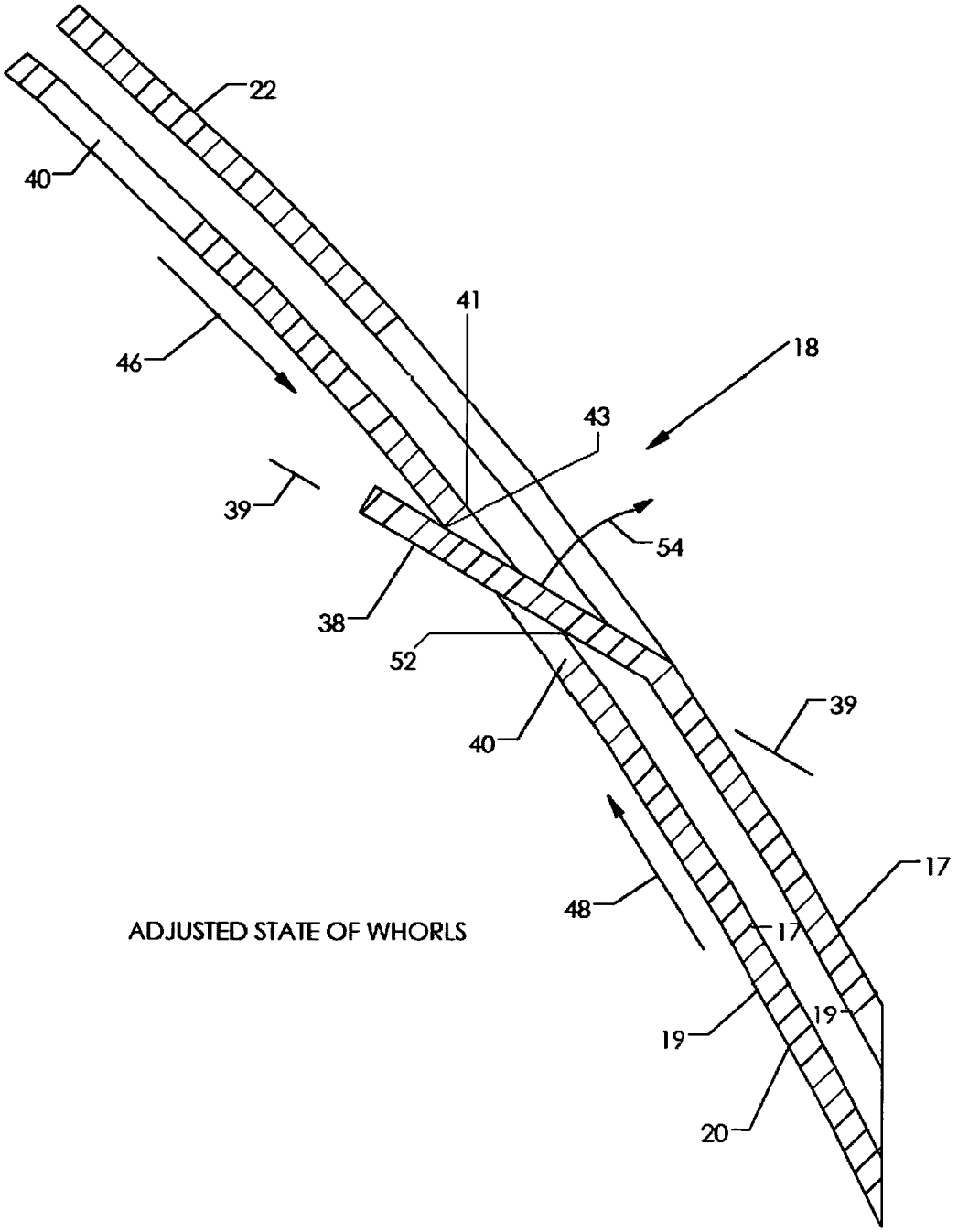
FIG. 4 is an enlarged cross-sectional view of the coiled mandrel circumference adjustment lock in operating position.
Figure 5:
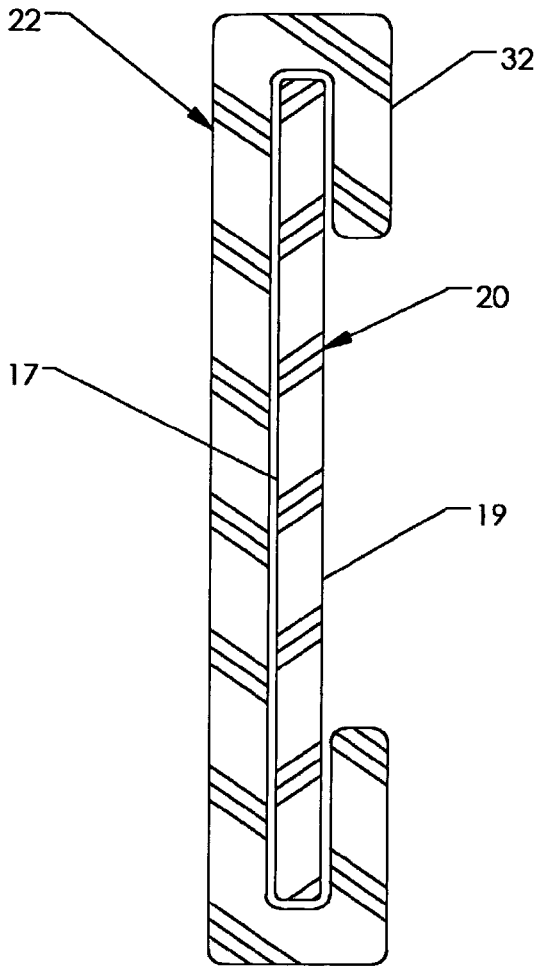
FIG. 5 is an enlarged cross-sectional view of the guide means area taken along line 5-5 in FIG. 1.
Figure 6:
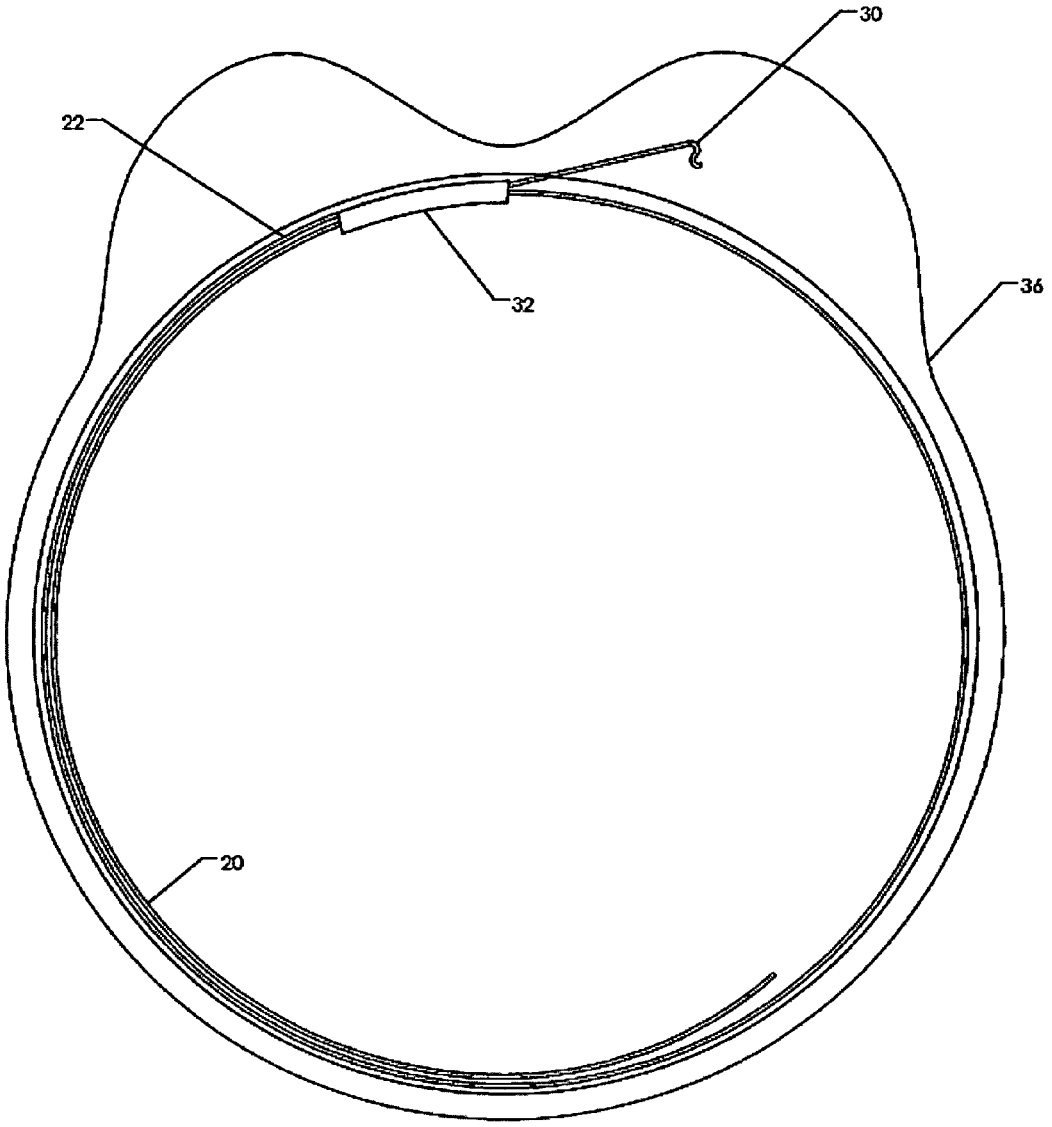
FIG. 6 shows the outwardly sprung proximal end portion of the outer whorl just after the starting locking tab (anchor tab) has been released.

A relief slot 42 is provided in the mandrel band (inner whorl 20) to receive tab 38 as shown in FIG. 3 when the mandrel is in its starting (initial) coiled state with the anchor tab 30 locked into anchor slot 26 in whorl 20. Anchor slot 26 and locking anchor tab 30 are wider than both relief slot 42 and adjusting tab 38 in order to prevent anchor tab 30 from locking into relief slot 42 during the initial coiling of the mandrel to its designed starting (initial) circumference state.

In embodiment (1) the wearer bends the mandrel into a loop and inserts the distal end section through the guide means and continues coiling the mandrel until its circumference is slightly less than the circumference of the generally circular elastic layed out bra base 36 (FIG. 1). The mandrel is then locked in its coiled state by anchor tab 30 and the bra base is then placed over the mandrel. The mandrel is then unlocked (item 30) and allowed to circumferentially expand against the elastic bra base 36 to the resiliency limit of the combination of mandrel and base or alternatively to the manually adjusted mandrel coil circumference wherein tab 38 locks the mandrel and bra into the desired expanded circumference to frictionally hold the bra onto the mandrel. The mandrel with the bra attached is then placed down over the wearers head and shoulders until stopped by the bra shoulder straps contacting the wearers shoulders. The tab 38 is then unlocked by the wearer by simply pulling the mandrel down and out of the bra base whereby the mandrel automatically resumes its linear state free of the wearer. It is noted that pulling down the coil by gripping one of the ears 44 will easily dislodge adjustment tab 38 from its slot 40.

In embodiment (2), the pre-coiled circumference of the mandrel is dimensioned preferably such that it will fit within the circular formed unstretched base of any bra as shown in FIG. 1. The coiled mandrel is then expanded by force provided by the wearer to engage against the bra base as shown in the embodiment of (1) above. The mandrel is then, along with the attached bra, locked into a desired circumference by tab 38 and slot 40 which prevents inopportune recoiling (contraction) of the mandrel away from the bra base 38. The subsequent procedures are the same as in (1) above. In this embodiment the provision of anchor tab 30 and slot 26 is not necessary in many situations.

The invention has been described in detail with particular reference to preferred embodiments thereof, but it will be understood that variations and modifications will be effected within the spirit and scope of the invention.

I claim:

1. A bra donning assist device for use by women who have only one functional arm, said device comprising a sheet band shaped mandrel having a proximal end section, a distal end section and an intermediate section and comprised of resilient material having in a coiled functional starting state an inner whorl, an outer whorl, a longitudinal (linear) length of from about three feet to about eight feet, a substantially uniform width of from about one in. to about eight in., and a substantially uniform thickness within the range of from about 1/32 in. to about 3/16 in., wherein a plurality of mandrel circumference adjustment slots are formed through said distal end section of said mandrel from side to side thereof wherein an edge portion of each said adjustment slot provides an adjustment lock shoulder, a releasable adjustment lock tab is provided on said proximal end section of said mandrel and extends resiliently radially inwardly and is adapted to extend through an adjacent adjustment slot when the mandrel coil is expanded up to a desired circumference wherein said adjustment lock tab engages a said adjustment lock shoulder to releasably lock said proximal end section of said outer whorl to said distal end section of said inner whorl of the coiled mandrel, and channel shaped guide means is provided on a portion of said proximal end section whereby said distal end section and said intermediate section can slide within said guide means to form the desired coiled and circumference configuration of said mandrel.

2. The device of claim 1 wherein said band is in a substantially flat linear configuration when said band is in its relaxed state, wherein an anchor lock tab is provided on said proximal end, and wherein an anchor slot is formed through said mandrel at said intermediate section and provides an anchor shoulder whereby when said mandrel is in its coiled state said anchor tab and said anchor shoulder are engaged to maintain said mandrel in its coiled state ready for use.

3. The device of claim 2 wherein said anchor lock tab is formed integrally with said mandrel and is adapted to be flexed to be released from said anchor lock shoulder to allow said mandrel to partially uncoil and circumferentially expand itself against the fastened elastic base of said bra.

4. The device of claim 1 wherein said guide means is curved longitudinally to further assist in guiding said mandrel into a coiled state.

5. The device of claim 1 wherein said mandrel is in a coiled form in its initial at rest state.

6. The device of claim 1 wherein a longitudinal axis of said adjustment tab is slanted radially inwardly from an inner surface portion of said proximal end section toward a terminal end of said proximal end section.

7. The device of claim 1 wherein said mandrel material is ABS plastic having a thickness of about 1/16 inch.

* * * * *